United States Patent [19]

Calandrello et al.

[11] 4,439,647

[45] Mar. 27, 1984

[54] TOUCHPAD KEYBOARD

[76] Inventors: Nick Calandrello, 7 Andover St., Andover, Mass. 01810; Robert Dimodana, 3 Lucy Ave., Pelham, N.H. 03076; Louis Skarbek, 153 Wilmington Rd., Burlington, Mass. 01803; Don Gove, 3 Highwood Rd., Manchester, Mass. 01944; Edwin Cooper, 143 Helvetia St.; John McKenzie, 11 Ellington Rd., both of Tewksbury, Mass. 01876

[21] Appl. No.: 398,374

[22] Filed: Jul. 14, 1982

[51] Int. Cl.[3] ..... H01H 13/70

[52] U.S. Cl. ..... 200/5 A; 200/86 R; 200/159 B; 200/DIG. 1; 200/52 R; 340/365 R; 361/288

[58] Field of Search ..... 200/5 R, 5 A, 52 R, 200/52 SE, DIG. 1, DIG. 2, 86 R, 1 R; 361/287, 288, 291; 340/365 R, 365 C, 365 S

[56] References Cited

U.S. PATENT DOCUMENTS

| | | | |
|---|---|---|---|
| 2,583,813 | 1/1952 | Burke | 200/86 R |
| 3,584,162 | 6/1971 | Krukinowski | 200/86 R X |
| 3,654,407 | 4/1972 | Kepner et al. | 200/86 R |
| 3,696,908 | 10/1972 | Gluck et al. | 200/DIG. 1 |
| 3,699,294 | 10/1972 | Sudduth | 200/86 R X |
| 3,797,630 | 3/1974 | Zilkha | 361/288 X |
| 3,830,991 | 8/1974 | DuRocher | 200/86 R |
| 3,932,722 | 1/1976 | Obata et al. | 200/5 A X |
| 3,965,399 | 6/1976 | Walker, Jr. et al. | 361/288 |
| 3,973,091 | 8/1976 | Kaminski | 200/5 A |
| 4,054,944 | 10/1977 | Lou | 200/5 E X |
| 4,090,045 | 5/1978 | Marsh | 200/5 A |

*Primary Examiner*—J. R. Scott

[57] ABSTRACT

An improved capacitive keyboard uses a standard printed circuit board provided in various locations with spaced conductor pairs. A conductive disc with a flat insulated lower surface is aligned above each conductor pair. All of the discs are suspended above the printed circuit board within apertures of a web of polymer foam material and held in position by a sheet of adhesive covered plastic that covers and adheres to the entire upper surface of the web and each of the discs.

7 Claims, 5 Drawing Figures

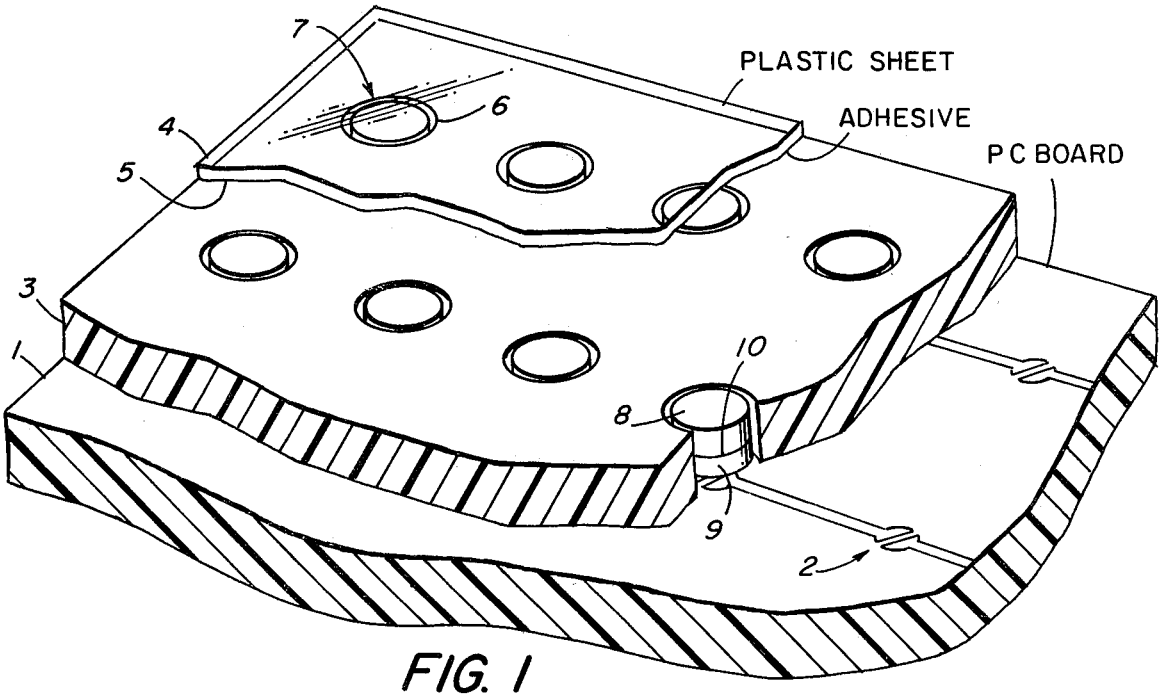
FIG. 1
FIG. 2
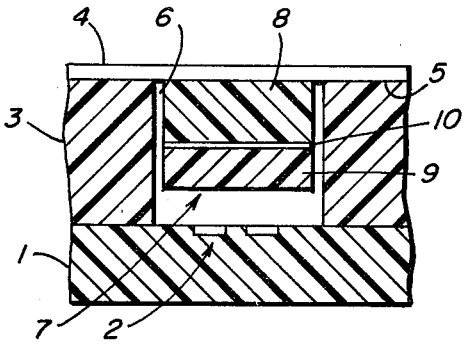
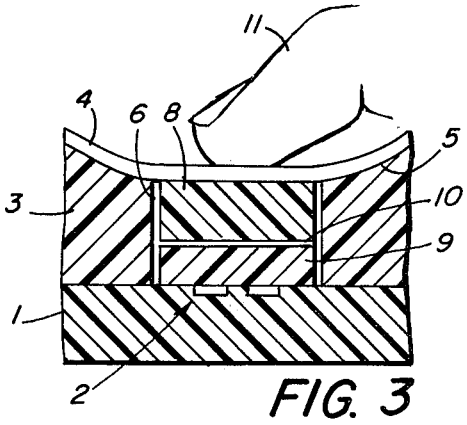
FIG. 3
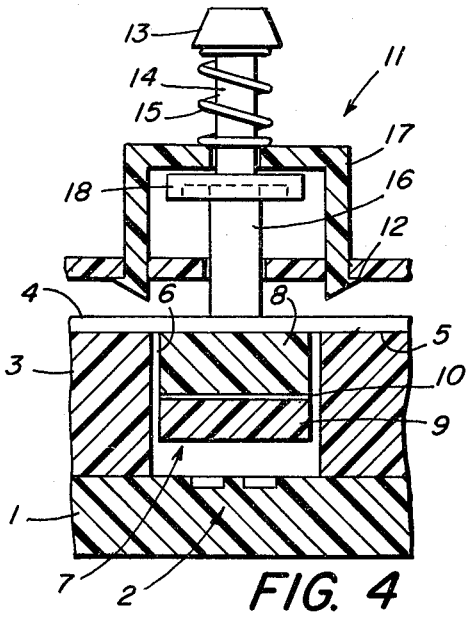
FIG. 4
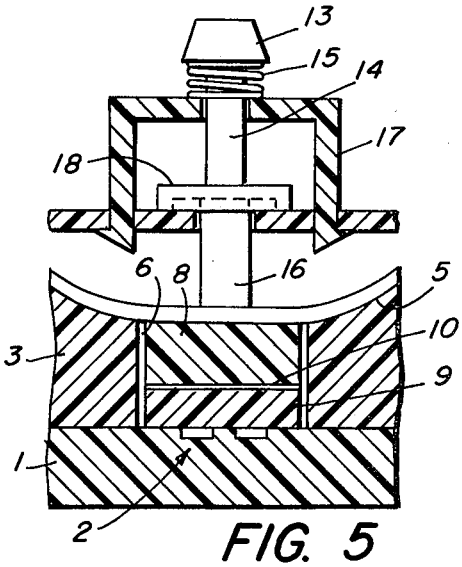
FIG. 5

TOUCHPAD KEYBOARD

BACKGROUND OF THE INVENTION

Keyswitches for keyboards may generally be divided into two basic types, conductive and capacitive. While both types have many common features the design problems associated with the two types differ. The two major design problems in conductive keyswitches are the prevention of oxides forming on the contact surfaces and the elimination of contact bounce.

In capacitive keyboards the formation of an oxide film on the switch members is unimportant since it is desirable to have the members insulated from each other. While contact bounce is not a major problem in capacitive keyboards another design problem arises in that tilting of the switching members at different angles with respect to the printed circuit board results in different capacitance for the same keyswitch struck at different angles. Thus, solutions in designing conductive keyboards may be difficult to utilize in the design of capacitive keyboards. Common to both types of keyboards are error signals in flat keyboards without keycaps caused by finger pressure on the edges of two adjacent keys where both keys produce signals although finger pressure was applied in the space between keys on a crowded keyboard.

The keyboard according to the invention was designed to minimize the occurance of tilted actuators in a keyboard of limited thickness and reduced cost.

A first type of prior art capacitive keyboard shown in U.S. Pat. Nos. 3,710,209; 3,751,612; 3,643,041 and 3,900,712 is the "snap action" type where a conductive dome is aligned above the conductor pairs of a printed circuit board and where downward pressure on the top of the dome causes the dome to arc downward toward the printed circuit board. In all the examples of this type of switch with the exception of the type shown in U.S. Pat. No. 3,900,712, the rounded shape of the moving switch member, or actuator, establishes weak capacitance with the printed board conductors. The latter prior art device uses a plastic dome provided with a foam pad actuator. The construction of the plastic dome apparently makes it necessary to use a flat keyswitch to depress it due to the obvious tendency of the plastic dome to depress irregularly, thereby bringing the moving contact toward the printed circuit board at an angle and off center.

A second type of keyswitch is exemplified by U.S. Pat. No. 3,797,630. In this prior art device a conductive elastomer pad is moved toward the printed circuit board with an actuator and is maintained above the printed circuit board by the use of a spring. Such a configuration requires a keyboard of a considerable height and a number of complicated parts to be manufactured. In addition, such keyboard needs some provision for keeping liquids from penetrating the space between keycaps and flowing onto the printed circuit board if a reasonable keyboard lifetime is desired.

A third type of prior art keyboard as shown in U.S. Pat. Nos. 3,968,488 and 3,696,908 uses a thin metal sheet, appropriately cut to form a plurality of springs surrounding a disc used as the actuator or movable capacitor plate of a capacitance switch. In order to maintain the metal sheet spaced from the printed circuit board a separating lattice must be used. In addition, the spring thus formed does not have a uniform spring constant around the periphery of the disc-shaped activator.

Thus, there is a tendency for an eccentrically depressed actuator to pivot prior to moving toward the printed circuit board, thereby resulting in non-uniform capacitance for a given key struck at various degrees of eccentricity. It is therefore necessary to provide additional equipment to insure that the actuators formed from the metal sheet are moved by devices that press the discs concentrically with a surface that is maintained parallel to the printed circuit board surface.

An interesting prior art conductive keyboard is shown in U.S. Pat. No. 4,017,848. In this device a plurality of parallel conductive strips is formed on a printed circuit board. A plurality of additional such strips are affixed to the side of a plastic sheet that faces the printed circuit board. The printed circuit board and sheet are separated by an insulating liquid sealed between them. Finger pressure on the sheet toward the printed circuit board causes the liquid to be pushed aside and permits one of the conductors on the plastic sheet to contact the printed circuit board conductor beneath it. It would be rather difficult to adapt such a keyboard to capacitive operation because different finger pressures would produce different contact areas, resulting in non-uniform capacitance.

A further prior-art keyboard type is shown in U.S. Pat. No. 3,668,698. In this device a flat conductive silicone rubber sheet has a right cylindrical projection above each spaced conductor pair on the printed circuit board. The sheet is held spaced from the printed circuit board by an insulating matrix. An electret film between the matrix and the printed circuit board insulates the printed circuit board conductors from the conductive rubber projections. As with the keyboards using a properly cut metal sheet to form the actuators the keyboards of U.S. Pat. No. 3,668,698 requires a separate matrix spaced from the printed circuit board to hold the actuators. In addition a small angular deflection at the top of the cylindrical projection causes the bottom end to swing through a large arc, so that misalignment with the spaced conductors of the printed circuit board is likely.

SUMMARY OF THE INVENTION

The invention greatly simplifies keyboard construction for both capacitive and conductive keyboards while increasing reliability. According to my invention a web of compressible material such as a closed cell neoprene sponge is placed over the printed circuit board. An aperture in the web is centered on each of the spaced conductors in the printed circuit board. Affixed to the top of the web is a plastic sheet with its bottom surface covered with adhesive. In each aperture of the web a conductive disc is positioned with its upper surface affixed to the plastic sheet by the adhesive. The discs are thinner than the sheet and therefore remain suspended above the printed circuit board. In the preferred embodiment the discs consist of a rigid plastic top layer affixed to the metal surface of a metallized mylar sheet. The lower surface of the mylar contacts the printed circuit board when pressure is applied on the plastic sheet above a disc. Due to the properties of the plastic sheet and the web the discs, even when pressed eccentrically, do not tend to rotate as they approach the printed circuit board and thus are generally parallel to the printed circuit board during a keystroke. This insures uniform capacitive coupling during each successive key stroke. Furthermore, the web accomplishes the functions both of the springs used in most other keyboards and the matrices used in keyboards with actuators formed from sheet metal or conductive silicone. The flexibility of the web and the plastic adhesive sheet facilitate the use of automated assembly for the keyboard. In addition the plastic sheet acts as a barrier for accidently spilled liquids, preventing the same from contaminating the printed circuit board. Customization of keyboards becomes simple with the apparatus according to the invention since standard printed circuit could be purchased; standard adhesive sheets could be acquired; and standard apertured webs could be stocked, customization being accomplished by selecting which of the apertures are filled with the plastic and metallized mylar discs and which are filled with the disc-shaped foam rubber plugs that result from punching the apertures in the web. The ability to customize keyboards using only standard parts is a cost saving feature of the invention. If the relative thickness of the rigid plastic disc is large in comparison to the metalized mylar, another way in which an inoperative key could be formed during customization would be to insert the disc assembly so that the mylar portion faces the adhesive thereby reducing the capacitance of a depressed actuator to less than that required for registration. Thus, the invention is a keyboard having a printed circuit board a web of compressible material having one side abutting the printed circuit board, a plurality of spaced conductor pairs on the printed circuit board and provided with apertures centered on the conductor pairs, rigid discs comprising conductive material in the apertures and having flat surfaces facing the conductor pairs, and means for retaining the discs in the apertures at a position normally spaced from the printed circuit board whereby pressure on any of the discs in a direction towards the printed circuit board causes the web to be locally compressed and the flat surface of the disc to move to a position abutting the printed circuit board and bridging the corresponding conductor pairs.

BRIEF DESCRIPTION OF THE DRAWINGS

The advantages of the above invention will become more readily apparent and the features better understood by reference to the following detailed description when taken in conjunction with the accompanying drawings in which:

FIG. 1 is a partial sectional view of a keyboard in accordance with a first embodiment of the invention, FIGS. 2 and 3 are sectional views of the keyboard of FIG. 1 prior and subsequent to the application of finger pressure on a key, and FIGS. 4 and 5 are sectional views of part of a keyboard in accordance with a second embodiment of the invention shown prior and subsequent to the application of finger pressure on a key.

DETAILED DESCRIPTION OF THE PREFERRED EMBODIMENTS

An embodiment of the invention shown in FIGS. 1–3 consists of a standard type of printed circuit board 1 with spaced pairs of conductors 2 that must be bridged by a moving conductor in order to produce sufficient capacitance between the conductors 2 to be registered by interrogation circuitry (not shown) connected to the keyboard. Such circuitry is shown in U.S. Pat. No. 4,163,222 to Gove, issued July 31, 1979, although other similar circuits could be adapted to operate with the keyboard according to the invention. Abutting the printed circuit board is a web 3 of a closed cell neoprene sponge rubber with apertures 6 that are centered on the spaced pairs of conductors 2 on the printed circuit board 1. Within the apertures 6 of the web 3 are disc shaped actuators 7 that each consist of a rigid plastic disc 8 that is affixed to the metalization layer 10 of a metalized mylar sheet 9. The discs are held in place with a sheet of flexible plastic 4 that has an adhesive layer 5 with which it is affixed to the web 3 and discs 5. The plastic sheet 4 covers the top of web 3 and, in addition to its function mentioned above, also acts as a moisture barrier to prevent liquids spilled on the keyboard from reaching the printed circuit board 1. Because the thickness of the actuators 7 is smaller than that of the web 3 the actuators normally remain spaced from the printed circuit board. As shown in FIG. 3 finger pressure on the plastic sheet 4 of the keyboard causes the foam rubber web 3 to compress locally to permit the actuator 7 to touch the printed circuit board, thereby bridging spaced conductors 2. The uniform compressibility of the web 3 surrounding the discs insures that if the disc is slightly eccentrically depressed the edge of the lower surface of the disc 7 touches the printed circuit board at an angle and then rotates to become parallel with the upper surface of the printed circuit board. On the other hand, if the actuator is depressed near its edge only the edge of the lower surface makes contact; thereby eliminating error signals when finger pressure is accidently applied in the space between keys of a crowded keyboard. The relatively thin disc insures that even if the disc does rotate through an angle its lower surface will not move far from being centered on the conductor pairs 2 of the printed circuit board 1.

In a second embodiment of the invention shown in FIGS. 4 and 5 a key 11 is mounted on a frame 12 above the disc shaped actuators 7. The key 11 consists of a keycap 13 mounted on a shaft 14 that is surrounded by a spring 15. At the end of the shaft 14 is a stop 18 that projects downward toward the Frame 12. Projecting from the stop is an elongated piece of stiff plastic foam 16. The key 11 is mounted on the Frame 12 with housing 17.

When the keycap 13 is pressed with finger pressure toward the actuator 7 the keycap 13 and the shaft 14 together with the stop 18 and elongated piece of plastic foam 16 move toward the actuator 7. The compressibility of the web is much greater than that of the plastic foam 16, so that after the plastic foam 16 contacts the actuator 7 the actuator moves downward until it contacts the printed circuit board 1. At this time the stop is above the frame 12. Further pressure on the keycap 13 compresses the plastic foam 16 against the actuator and permits the stop 18 to contact the top of the frame 12 inside the housing 17. Throughout the keystroke the spring 15 is compressed between the keycap 13 and the housing 17. When pressure is released from the top of the keycap 13 the spring 15 moves the key back to its rest position shown in FIG. 4.

As in prior art keyboards liquids accidently spilled on the frame 12 may leak down through the openings in the frame used to secure and permit the operation of the keys, but such liquids in a keyboard according to the invention will flow harmlessly off the adhesive plastic 4 without contacting the conductors in the printed circuit board. Slight misalignment between the plastic foam 16 and the actuator 7 will not, due to the properties of the adhesive coated plastic sheet 4 and the foam plastic web 3, cause the actuator to be displaced from the conductor pairs 2 or rotated to any substantial degree with respect to printed circuit board 1.

While the preferred embodiments have been described in great detail, it should be obvious to the skilled artisan that many variations are possible. The discs, for example could be made of solid metal; the web need not be foam rubber but can be any material with sufficient compressibility to permit the actuators to move from their rest positions to a position abutting the printed circuit board using finger pressure. The plastic sheet may be a simple common cellophane tape or any other similar material capable of being coated with an adhesive. Other methods of securing the actuators 7 within the apertures 6 in the web are also possible without the use of the plastic sheet 4. Many other variations are also possible. Therefore the preferred embodiments are illustrative only and are merely examples of the invention expressed in the following claims.

I claim:

1. A keyboard comprising a printed circuit board, a plurality of spaced conductor pairs on a surface of said printed circuit board, a web of compressible material having one side abutting said surface of said printed circuit board and provided with apertures centered on said conductor pairs, a rigid disc comprising conductive material in each of said apertures and having a flat surface facing each of said conductor pairs, and means comprising a flexible plastic sheet covering the side of said web opposite said one side and connected to the sides of the discs opposite said flat surfaces for retaining said discs in said apertures at a position normally spaced from said printed circuit board, said discs being thinner than said web, whereby pressure on any of said discs in a direction toward said printed circuit board causes the flat surface of said one of said discs to move to a position abutting said printed circuit board and bridging said corresponding conductor pair.

2. A keyboard as recited in claim 1, wherein said sheet is provided on the web side with adhesive material, said sheet being affixed both to said web and said discs by said adhesive material.

3. A keyboard as recited in claim 1, wherein the lower surfaces of said discs are covered with a thin layer of dielectric material, whereby said discs function as the movable members of capacitive switches.

4. A keyboard as recited in claim 1, wherein each disc comprises a metalized mylar sheet with the metalization facing away from said printed circuit board, and a rigid plastic member affixed to the metalization.

5. A keyboard as recited in claim 4, wherein said sheet is provided on the web side with adhesive material, said sheet being affixed both to said web and said discs by said adhesive material.

6. A keyboard as recited in any of claims 1, 2, 3, 4 or 5, further comprising a frame on the side of the web opposite the printed circuit board, and a manually depressable key aligned with each disc and actuable from a rest position to an operating position closer to said printed circuit board each said key provided with means for applying pressure on its associated disc toward the printed circuit board in the operating position of said key.

7. Apparatus as recited in claim 6, wherein the means for applying pressure on the disc associated with a key comprises a material that is compressible to a lesser degree than the web material.

* * * * *